US008307691B1

(12) United States Patent
Bolander

(10) Patent No.: US 8,307,691 B1
(45) Date of Patent: Nov. 13, 2012

(54) SWIVEL BASE FOR A CONDUIT BENDER

(76) Inventor: Steven Bolander, Lebanon, TN (US)

( * ) Notice: Subject to any disclaimer, the term of this patent is extended or adjusted under 35 U.S.C. 154(b) by 73 days.

(21) Appl. No.: 12/856,778

(22) Filed: Aug. 16, 2010

(51) Int. Cl.
*B21D 7/04* (2006.01)

(52) U.S. Cl. ..... 72/458

(58) Field of Classification Search ..... 72/458, 72/459

See application file for complete search history.

(56) References Cited

U.S. PATENT DOCUMENTS

| | | | | | |
|---|---|---|---|---|---|
| 1,054,132 | A * | 2/1913 | Miner | 72/390.4 |
| 1,835,264 | A * | 12/1931 | Blythe | 72/157 |
| 3,253,441 | A | 5/1966 | Benfield | |
| 3,949,584 | A | 4/1976 | Pearson et al. | |
| 4,269,056 | A | 5/1981 | Kozinski | |
| 4,321,820 | A * | 3/1982 | Nason | 72/459 |
| 4,372,145 | A * | 2/1983 | Giordano et al. | 72/387 |
| 4,425,784 | A * | 1/1984 | D'Gerolamo | 72/459 |
| 4,587,832 | A | 5/1986 | Illguth | |
| 6,457,344 | B2 | 10/2002 | Godin | |
| 6,792,790 | B2 * | 9/2004 | Ritter | 72/458 |
| 6,912,886 | B1 | 7/2005 | Maes | |
| 7,757,537 | B1 * | 7/2010 | Hartranft | 72/458 |
| 2003/0115928 | A1 * | 6/2003 | Savard et al. | 72/458 |
| 2010/0294017 | A1 * | 11/2010 | Janversan | 72/458 |

* cited by examiner

*Primary Examiner* — Faye Francis
(74) *Attorney, Agent, or Firm* — Montgomery Patent & Design, LLC; Robert C. Montgomery; Joseph Yaksich

(57) ABSTRACT

A pivoting device for use with a manual conduit bender comprises an attachable foot portion with a non-slip rubber bottom layer and a pivoting center axle insertingly received into a bottom end of a conduit bender handle. The device is placed on the ground or other supporting surface and provides stability and improved leverage while a conduit is bent in the conduit bender.

11 Claims, 5 Drawing Sheets

SWIVEL BASE FOR A CONDUIT BENDER

RELATED APPLICATIONS

The present invention was first described in a notarized Official Record of Invention on Mar. 31, 2009, that is on file at the offices of Montgomery Patent and Design, LLC, the entire disclosures of which are incorporated herein by reference.

FIELD OF THE INVENTION

The present invention relates generally to pipe and conduit bending devices, and in particular, to a swivel base attachable to a manual conduit bender.

BACKGROUND OF THE INVENTION

The use of Electrical Metallic Tubing (EMT) as a common conduit system used in residential, commercial and industrial wiring installations provides a useful method of distributing power and control wiring. It is easy to store, transport and cut, and provides a fairly high level of protection from physical damage. However, any special bends or offsets require the use of manually-operated or electrically-powered conduit benders.

Manually-operated conduit benders are a fairly simple and low cost tool used to create a desired bend or offset. However, these benders typically require time and some skill to bend a conduit properly the first time. Such time and routine errors quickly translate into lost revenue on the job which can become magnified each time the conduit has to be taken down for additional bending. One (1) significant factor affecting the performance of a manual conduit bender is that it is prone to slipping upon the floor or ground surfaces or due to its natured handle which is nothing more than a piece of pipe. Additionally, these manual benders tend to rotate and shift during use which can skew the degree and direction of the initially intended bend.

There are numerous variations of manual pipe and conduit bending devices. Most require some visual observation during the bending process to identify when the desired bend has been achieved. Typically these manual bending devices are affixed to an end of a pipe which then engages a length of conduit on a floor surface at the work site. This configuration puts the working end of the bender away from the user's eyes and requires frequent stops and starts during the bending process, each time creating a possibility the conduit will shift within the bender which can eventually produce an incorrect bend. Examples of these types of manual conduit benders can be seen in several U.S. Patents; including: U.S. Pat. No. 3,253,441, issued in the name of Benfield, which discloses a pipe bending tool; U.S. Pat. No. 4,269,056, issued in the name of Kozinski, which discloses a conduit bender having a curved rocker base; U.S. Pat. No. 4,321,820, issued in the name of Nason, which discloses a pipe-bending tool including a pipe-bending head mounted to a handle having an adjustable gauge for judging a desired bend angle; U.S. Pat. No. 4,372,145, issued in the name of Giordano et al., which discloses a conduit bending apparatus for bending wiring conduit projecting upward from a floor surface; and, U.S. Pat. No. 4,587,832, issued in the name of Illguth, which discloses a pipe bending tool including an audible signal to indicate to a user that a desired bend angle has been achieved.

Other variations include manual conduit benders which provide stand or other mountable support frame. Examples of these types of devices can be seen in U.S. Pat. No. 6,457,344, issued in the name of Godin, which discloses a bender stand for facilitating conduit bending using a hand bender; and, U.S. Pat. No. 6,912,886, issued in the name of Maes, which discloses a bending apparatus for pipe and tubing adapted to be mounted to a vise to hold the apparatus.

Electrically operated conduit benders eliminate much of this error; however, they can be cost prohibitive in many situations. Examples of these devices can be seen in U.S. Pat. No. 3,949,584, issued in the name of Pearson et al., which discloses an electrically driven portable conduit bender for EMT conduit and other tubing.

While these devices may accomplish their specific intended purpose, each suffers from one (1) or more disadvantage or deficiency with respect to design, function, or effectiveness. Accordingly, there exists a need for a means by which a manual conduit bender can be used without worry of slippage or possible floor damage. The development of the present invention substantially departs from the conventional solutions and in doing so fulfills this need.

SUMMARY OF THE INVENTION

In view of the foregoing references, the inventor recognized the aforementioned inherent problems and lack in the art and observed that there is a need for novel tool for effectively and accurately bending conduit, pipe, and other thin walled material. Thus, the object of the present invention is to solve the aforementioned disadvantages and provide for this need.

Another object of the present invention is to provide a device which is used with various types and designs of manually operated conduit benders.

Yet another object of the present invention is to provide a device which prevents damage to a floor or other work surface.

Yet another object of the present invention is to provide a device provides increased control over the manual conduit bending procedure which produces better and more accurate results.

Yet still another object of the present invention is to provide a device which is simple and intuitive to use with little to no training.

Yet still another object of the present invention is to provide a device which is durable and economical to manufacture.

One (1) or more of these and other objects of the invention are achieved by providing a base for a stabilizing a conduit bender during the pipe bending process. The base including a generally rectangular foot plate having a flat top surface, a flat bottom surface, and a pair of generally triangular side plates which extend upwardly from opposing longitudinal sides of the top surface; a cylindrical shaft having a first tubular section and a second tubular section; and, an axle for pivotably connecting the first tubular section between the pair of side plates. During use the foot plate is placed on a flat work surface and the second tubular end is removably inserted into a hollow handle portion of the conduit bender.

In at least one embodiment of the invention, one (1) or more of the objects of the invention are achieved by providing a lower end portion of the first tubular section having a pair of opposing shaft axle apertures and an upper end of the pair of side plates each including a side plate axle aperture, whereby the shaft axle apertures and the side wall axle apertures are aligned along a common axis for receiving the axle for providing a single axis of rotation to the shaft in relation to the foot plate.

In at least one (1) embodiment of the invention, one (1) or more of the objects of the invention are achieved by providing a pad affixed to the bottom surface of the foot plate for providing a high friction surface between the foot plate and the flat work surface. Additionally, in at least one (1) embodiment of the invention the first tubular section includes a pair of opposing friction springs affixed to an exterior surface. The pair of friction springs provide a spring force upon an interior of the hollow end of the conduit bender handle portion for retaining the first tubular section therewithin.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | swivel base for a conduit bender |
| 22 | foot plate |
| 24 | side plate |
| 26 | pad |
| 27 | pad aperture |
| 28 | anchoring aperture |
| 30 | first axle aperture |
| 40 | adapter |
| 42 | first tubular section |
| 44 | second tubular section |
| 46 | friction spring |
| 48 | second axle aperture |
| 60 | axle |
| 62 | pin aperture |
| 64 | locking pin |
| 80 | fastener |
| 100 | post |
| 105 | conduit bender |
| 110 | conduit |
| 200 | supporting surface |

DETAILED DESCRIPTION OF THE PREFERRED EMBODIMENT

Figure 1:
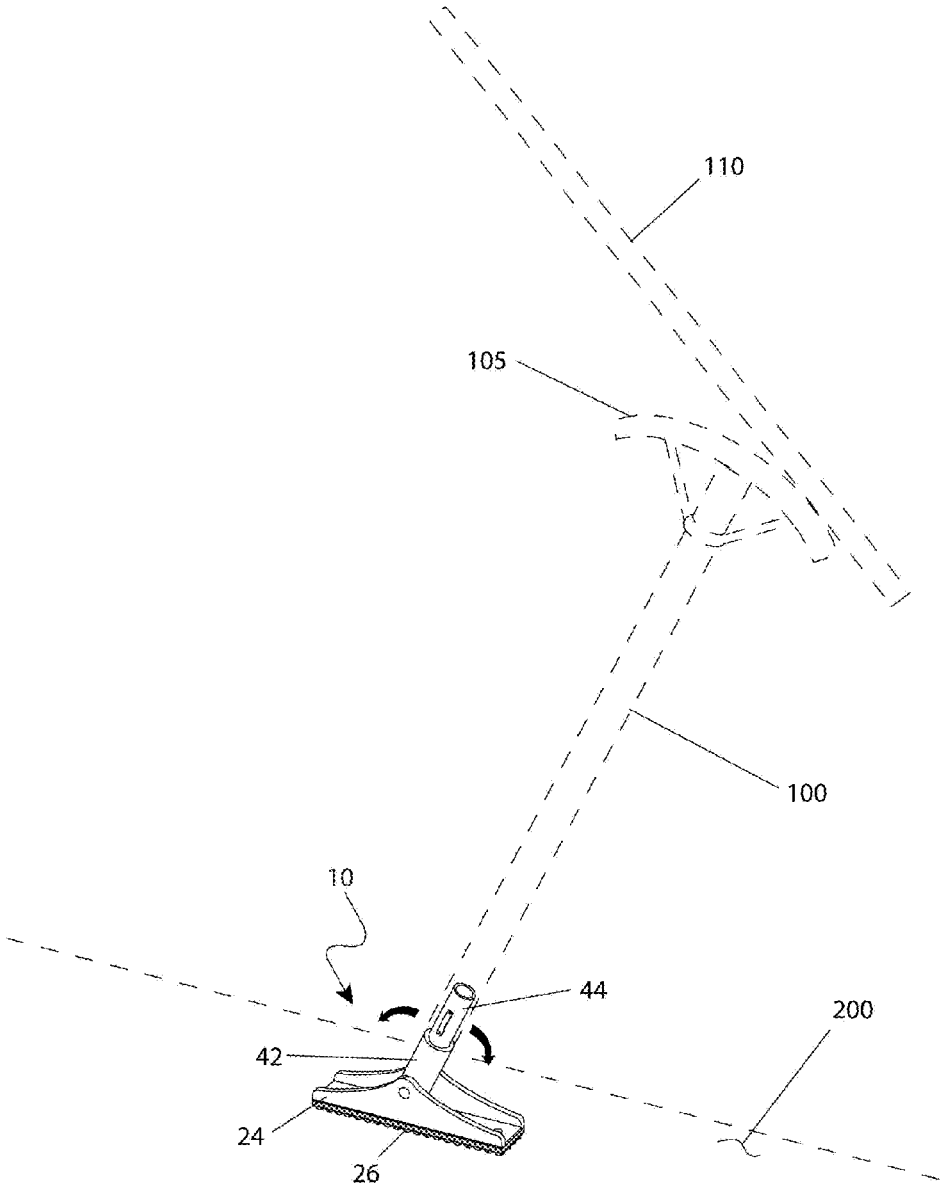
FIG. 1 is an environmental view of a swivel base for a conduit bender 10 depicting an in-use state, according to a preferred embodiment of the present invention.
Figure 2A:
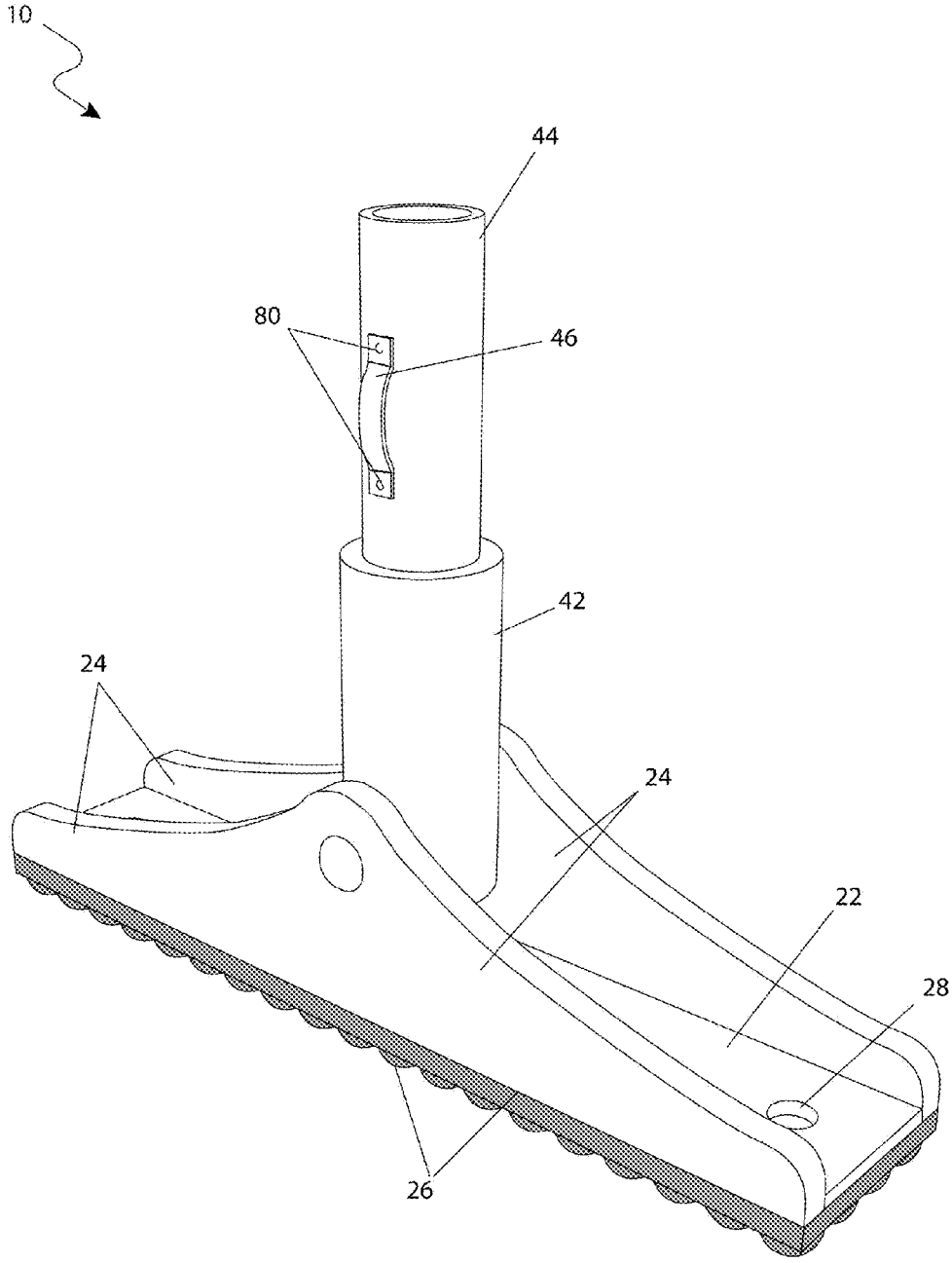
FIG. 2*a* is a close-up view of the swivel base for a conduit bender 10, according to a preferred embodiment of the present invention.
Figure 2B:
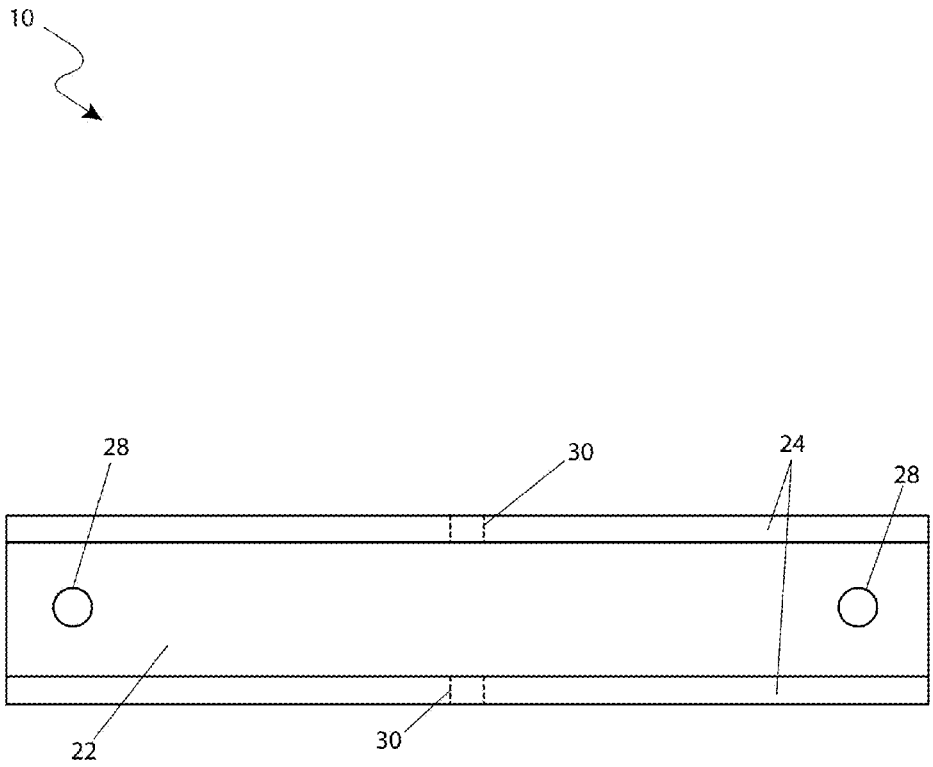
FIG. 2*b* is a top view of the swivel base for a conduit bender 10 depicting a foot plate portion 22, according to a preferred embodiment of the present invention.
Figure 2C:
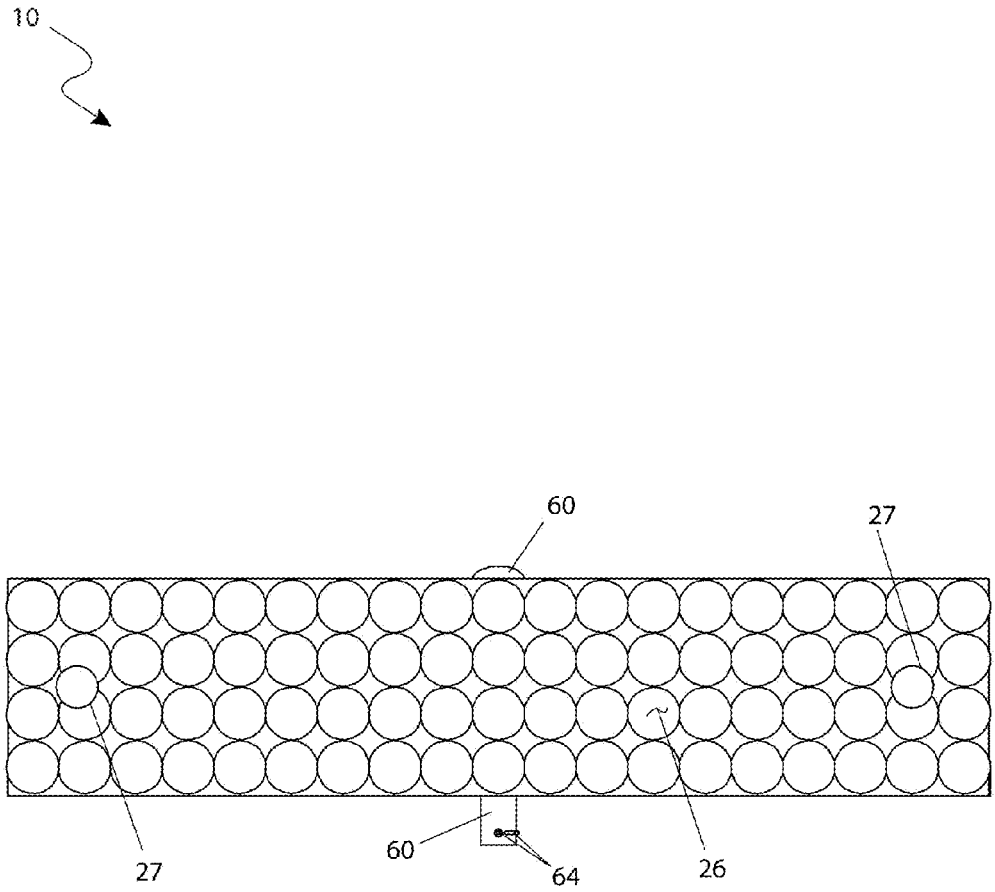
FIG. 2*c* is a bottom view of the swivel base for a conduit bender 10 depicting a pad portion 26, according to a preferred embodiment of the present invention; and, FIG. 3 is an exploded view of the swivel base for a conduit bender 10 according to a preferred embodiment of the present invention.
Figure 3:
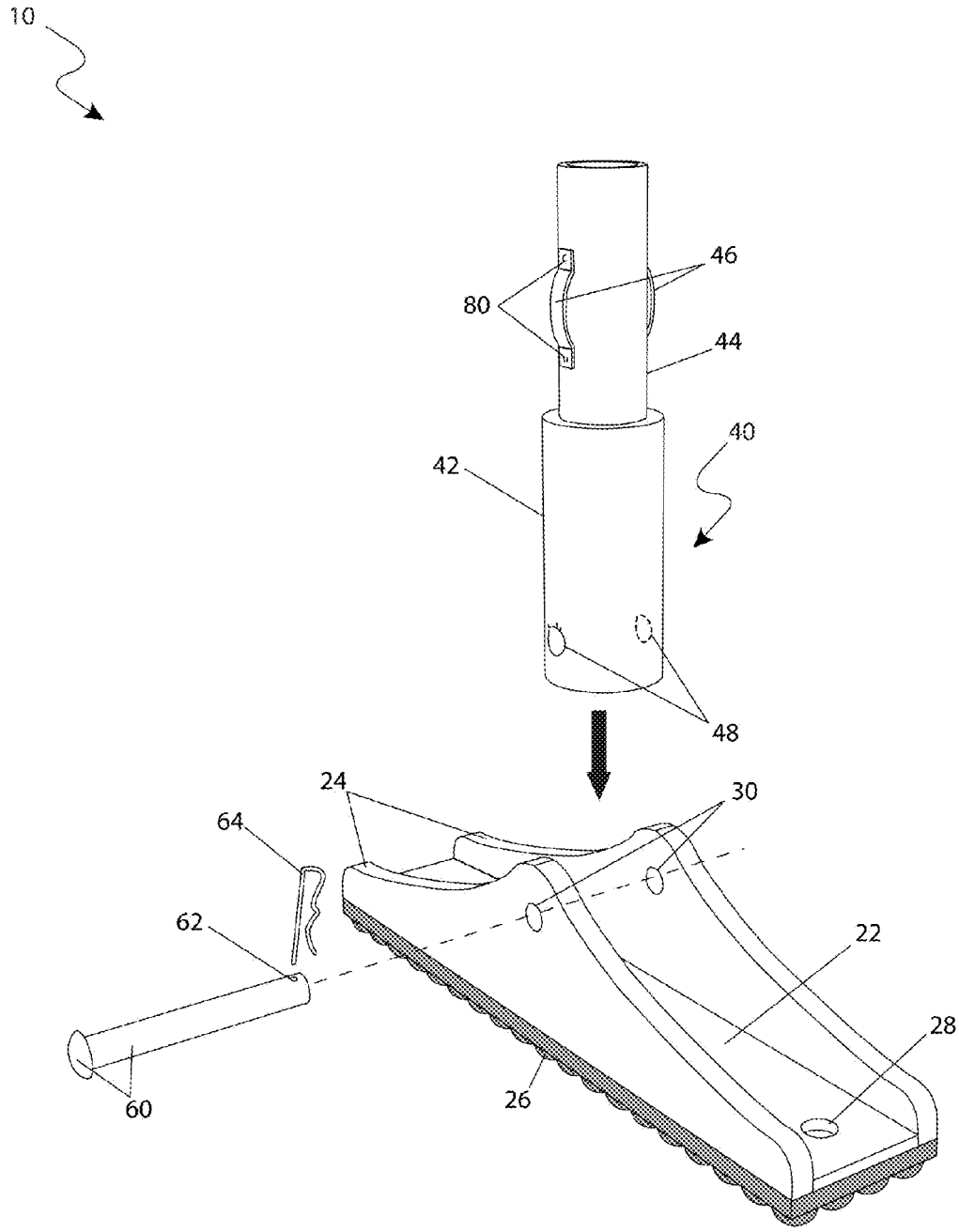

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a swivel base for a conduit bender (herein described as the "device") 10, providing a pivoting foot portion for use with manual conduit benders 105, the device 10 comprising a foot plate 22 with a non-slip rubber pad 26, and an adapter 40 which allows the device 10 to be attached to a post portion 100 of a conduit bender 105.

Referring now to FIG. 1, an environmental view of the device 10 depicting an in-use state, according to a preferred embodiment of the present invention, is disclosed. The device 10 is placed securely upon a supporting surface 200, thereby stabilizing the conduit bender 105 during shaping of a length of conduit 110 in a conventional manner. Thus, as a user moves the conduit 110 along the conduit bending head 105 to produce a desired bend, the device 10 stabilizes the conduit bender 105 during the bending process and prevents slipping or damage on the supporting surface 200.

Referring now to FIGS. 2*a* through 2*c* and 3, various views of the device 10, according to a preferred embodiment of the present invention, are disclosed. The device 10 comprises metal portions preferably made using a sturdy light-weight metal such as aluminum, steel, or the like. The device 10 comprises a foot plate 22, an adapter 40, and a connecting axle 60. The foot plate 22 provides an anchoring means comprising a "U"-shaped metal member having a pair of generally triangularly-shaped side plates 24 which extend upwardly at right angles from outer edges of the foot plate 22 in a parallel arrangement to each other. The foot plate 22 further comprises a pair of anchoring apertures 28 formed or drilled through which provide a means to attach the device 10 in a permanent or semi-permanent manner to a floor or other supporting surface 200 using various mechanical fasteners 80 such as a screws, nails, or similar anchoring fasteners, if additional stability during the conduit bending process is desired. The foot plate 22 further comprises a high-friction pad affixed to an entire bottom surface of the foot plate 22. The pad 26 comprises a textured soft plastic or rubber layer approximately one-quarter (¼) of an inch thick being securely attached to the foot plate 22 preferably using a construction adhesive or equivalent fastening method such as rivets, screws, or the like. The pad 26 further comprises a pair of pad apertures 27 formed or drilled through the pad 26 and positioned correspondingly with the aforementioned anchoring apertures 28. The pad 26 provides high-friction contact between the device 10 and a subjacent supporting surface 200, thereby stabilizing the device 10 against the supporting surface 200 during a conduit bending task (see FIG. 1).

Each side plate 24 comprises a circular first axle aperture 30 formed or machined therethrough. The two (2) first axle apertures 30 are aligned along a common axis and provide a means for rotatingly attaching the adapter 40 to the side plates 24 via sliding insertion of the axle 60 therethrough. The axle 60 comprises an elongated cylindrical fastener approximately one-quarter (¼) inch in diameter and having a domed head.

Coincidental insertion of the axle 60 through the first axle apertures 30 and a pair of corresponding and axially aligned second axle aperture portions 48 formed through a first tubular section 42 of the adapter 40 enables a single-axis rotating motion between the side plates 24 and the adapter 40. The axle 60 is secured in the installed position via insertion of a common locking pin 64 such as a hitch pin, cotter pin, or the like, through an integral pin aperture portion 62 of the axle 60.

The adapter 40 comprises a linear tubular member which provides sliding attachment of the device 10 to a post portion 100 of the conduit bender 105. The adapter 40 comprises a larger outer diameter along a lower half portion, and a smaller outer diameter along an upper half portion, thereby defining a first tubular section 42 and a second tubular section 44, respectively. The second tubular section 44 comprises a particular outer diameter allowing sliding insertion into the post portion 100 of the conduit bender 105. The second tubular section 44 also provides a means to retain the adapter 40 within the post 100 via a pair of bow-shaped protruding friction springs 46. The springs 46 are mounted in an opposing manner along an outer surface of the second tubular section 44 using fasteners 80 such as rivets, screws, or the like. The friction springs 46 provide a compressive interference fit between the second tubular section 44 and an inner bore of the post portion 100 of the conduit bender 105, thereby providing a resistant removable attachment of the device 10 thereto.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed and utilized as indicated in FIG. 1.

The method of utilizing the device 10 may be achieved by performing the following steps: assembling the foot plate 22 to the adapter 40 by inserting the axle 60 through the first 30 and second 48 aperture portions, if not previously assembled; securing the axle 60 in place using the locking pin 64; inserting the second tubular section 44 into an inner bore of the post portion 100 of the conduit bender 105 wherein the pair of springs 46 engage an inner wall of the post 100 of the conduit bender 105; anchoring the foot plate 22 to a floor or other supporting surface 200, if desired, by installing a fastener such as a nail or screw through the pad 27 and anchoring 28 aperture(s) in an event that additional stability is desired; motioning the adapter 40 and attached post portion 100 of the conduit bender 105 angularly to a desired position; inserting and bending a desired number of lengths of conduit 110 using the conduit bender 105; and, benefiting from improved stability during a conduit bending task as well as protecting a supporting surface 200 while utilizing the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A stabilizer for a conduit bender during a pipe bending process comprising:

a foot plate comprising a flat top and bottom surface adapted to be placed on a work surface; and, a linear cylindrical shaft comprising an upper end and a lower end, said shaft lower end being pivotably attached to said foot plate;

wherein said shaft upper end is suitably sized to be removably inserted into a handle portion of said conduit bender;

wherein said foot plate further comprises:

a pad affixed to said bottom surface for providing a high friction surface between said foot plate and said work surface;

a pair of opposing side plates extending upward from said top surface; and, an axle extending through said shaft lower end and attached between said pair of opposing side plates for pivotably connecting said shaft lower end to said pair of side plates;

wherein said foot plate further comprises a pair of foot plate anchoring apertures and said pad further comprises a pair of pad anchoring apertures;

wherein said pair of foot plate anchoring apertures and said pair of pad anchoring apertures are aligned to receive anchoring fasteners for rigidly securing said foot plate to said work surface;

wherein said shaft upper end further comprises a first diameter suitably sized for being slidably insertable into a hollow end of said conduit bender and said shaft lower end further comprises a second diameter suitably sized for retaining said hollow end of said conduit bender, said first diameter being less than said second diameter; and, wherein said shaft upper end further comprises a pair of friction springs for retaining said shaft within said hollow end of said handle portion.

2. A stabilizer for a conduit bender during a pipe bending process comprising:

a generally rectangular foot plate comprising a flat top surface, a pair of generally triangular side plates extending upwardly from opposing longitudinal sides of said top surface, and flat bottom surface adapted to be placed on a work surface;

a linear cylindrical shaft comprising a first tubular section and a second tubular section suitably sized to be removably inserted into a handle portion of said conduit bender; and, an axle extending through said first tubular section and attached between said pair of side plates for pivotably connecting said first tubular section to said pair of side plates.

3. The stabilizer of claim 2, wherein a lower end portion of said first tubular section further comprises a pair of opposing shaft axle apertures and an upper end of said pair of side plates each further comprises a side plate axle aperture;

whereby said shaft axle apertures and said side wall axle apertures are aligned along a common axis for receiving said axle for providing a single axis of rotation to said shaft in relation to said foot plate.

4. The stabilizer of claim 3, wherein said first tubular section further comprises a first diameter adapted to be slidingly received by a hollow end of said handle portion of said conduit bender and said second tubular section further comprises a second diameter larger than an inner diameter of said hollow end of said handle portion of said conduit bender.

5. The stabilizer of claim 4, wherein said first tubular section further comprises a pair of opposing friction springs affixed to an exterior surface, said pair of friction springs providing a spring force upon an interior of said hollow end of said handle portion for retaining said first tubular section therewithin.

6. The stabilizer of claim 5, wherein each of said pair of friction springs further comprises bow-shaped spring having two opposing ends, wherein said two opposing ends are affixed to said second tubular section by mechanical fasteners.

7. The stabilizer of claim 5, wherein said foot plate further comprises a pair of foot plate anchoring apertures for receiving anchor fasteners to rigidly secure said foot plate to said work surface.

8. The stabilizer of claim 7, wherein said base further comprises a pad affixed to said bottom surface for providing a high friction surface between said foot plate and said work surface.

9. The stabilizer of claim 8, wherein said pad further comprises a pair of pad anchoring apertures disposed in alignment with said pair of foot plate anchoring apertures for receiving anchor fasteners to rigidly secure said foot plate to said work surface.

10. The stabilizer of claim 9, wherein each of said pair of friction springs further comprises bow-shaped spring having two opposing ends, wherein said two opposing ends are affixed to said second tubular section by mechanical fasteners.

11. The stabilizer of claim 10, wherein said pad further comprises a rubber material having a thickness of approximately one-quarter inch.

* * * * *